US006508534B1

(12) United States Patent
Yusef et al.

(10) Patent No.: US 6,508,534 B1
(45) Date of Patent: Jan. 21, 2003

(54) CARRIAGE DRIVE BELT WITH COMPLIANT BELT SECTION FOR INKJET PRINTER

(75) Inventors: Haseeb Yusef, Vancouver, WA (US); Daniel Lander, Brush Prairie, WA (US)

(73) Assignee: Hewlett-Packard Company, Fort Collins, CO (US)

( * ) Notice: Subject to any disclaimer, the term of this patent is extended or adjusted under 35 U.S.C. 154(b) by 24 days.

(21) Appl. No.: 10/002,651

(22) Filed: Oct. 19, 2001

(51) Int. Cl.[7] ..... B41J 23/00; B41J 19/56
(52) U.S. Cl. ..... 347/37; 400/335
(58) Field of Search ..... 347/37–39; 400/323, 400/335, 352

(56) References Cited

U.S. PATENT DOCUMENTS 5,465,107 A 11/1995 Mayo et al. ..... 347/37
5,779,376 A 7/1998 Seu ..... 400/335
5,964,542 A * 10/1999 Ruhe et al. ..... 400/352
6,045,212 A * 4/2000 Ruhe et al. ..... 347/37
6,257,781 B1 7/2001 Harris ..... 400/323

* cited by examiner

*Primary Examiner*—Raquel Yvette Gordon
*Assistant Examiner*—An H. Do

(57) ABSTRACT

A carriage drive belt for an inkjet printer includes an elongated belt section and compliant belt section secured to the elongated belt section. The elongated belt section has a longitudinal axis and includes a first portion and a second portion spaced from the first portion along the longitudinal axis. The compliant belt section extends between the first portion and the second portion of the elongated belt section and has an axis extending in a direction of the longitudinal axis of the elongated belt section.

45 Claims, 7 Drawing Sheets

CARRIAGE DRIVE BELT WITH COMPLIANT BELT SECTION FOR INKJET PRINTER

THE FIELD OF THE INVENTION

The present invention relates generally to inkjet printers, and more particularly to an inkjet printer including a carriage drive belt having a compliant belt section which provides varying tension with displacement.

BACKGROUND OF THE INVENTION

A conventional inkjet printing system includes a printhead assembly, an ink supply which supplies liquid ink to the printhead assembly, and an electronic controller which controls the printhead assembly. The printhead assembly, commonly referred to as a print carriage or a pen, ejects ink drops through a plurality of orifices or nozzles and toward a print medium, such as a piece of paper, to print onto the print medium. Typically, the orifices are arranged in one or more arrays such that properly sequenced ejection of ink from the orifices causes characters or other images to be printed upon the print medium as the printhead assembly and the print medium are moved relative to each other.

To position the printhead assembly relative to the print medium, the conventional inkjet print system includes a carriage assembly. Typically, the carriage assembly includes a carriage and a carriage drive assembly. As such, the printhead assembly is positioned in, and supported by, the carriage and the carriage drive assembly moves the carriage and, therefore, the printhead assembly back and for the across the print medium.

As illustrated in FIG. 1, a conventional carriage drive assembly 200 typically includes a drive pulley 202, a drive belt 204, an idler pulley 206, and a belt tension spring 208. The idler pulley is spaced from the drive pulley, and the drive belt extends between and around the drive pulley and the idler pulley. The drive pulley is attached to a drive motor (not shown) by a drive shaft 210 to transfer power to the drive pulley and the drive belt. Power transfer from the drive pulley to the drive belt moves a section of the drive belt back and forth between the drive pulley and the idler pulley. Typically, the drive pulley and/or the idler pulley has a reciprocal toothed contour designed to mate with the toothed contour of the drive belt. A carriage 212 (only a portion of which is illustrated in FIG. 1) is attached to the drive belt such that the carriage moves with the drive belt between the drive pulley and the idler pulley.

The belt tension spring and the idler pulley interact such that the belt tension spring pushes or biases the idler pulley away from the drive pulley to provide a pre-load tension in the drive belt. This pre-load tension provides a static axial force or nominal tension in the drive belt before and during acceleration of the carriage from rest. As such, the pre-load tension maintains sufficient contact between the drive belt and the drive pulley. By maintaining proper contact between the drive belt and the drive pulley, power is more efficiently transmitted from the drive pulley to the drive belt. The belt tension spring also functions to temper vibration caused by interaction of the drive belt and the drive pulley as well as compensate for manufacturing variations and/or environmental conditions such as temperature or humidity.

Interaction between the belt tension spring and the idler pulley requires that the idler pulley vary its position in response to force applied by the belt tension spring. Thus, the carriage drive assembly must include an adjustable or moveable idler pulley. Unfortunately, providing the carriage drive assembly with a moveable idler pulley adds to the manufacturing complexity and cost of the carriage drive assembly since additional components and manufacturing steps are required compared with a fixed pulley design.

One arrangement for providing a pre-load tension in a drive belt was included in the ScanJet 6300C/Cse/Cxi series scanners produced by Hewlett-Packard Company of Palo Alto, Calif., the present assignee. This arrangement included a coil spring wound in a direction perpendicular to a length of the drive belt with projecting arms at opposite ends which were hooked over the drive belt. This arrangement, however, is unsuitable for drive systems requiring high acceleration, such as an inkjet printing system, because the arms will deflect before the coil spring windings thereby reducing a desired pre-load tension in the drive belt and resulting in slip between the drive belt and the drive motor pulley.

Accordingly, a need exists for a belt tensioning arrangement for a carriage drive assembly of an inkjet printer which reduces manufacturing complexity and cost by operating between fixed drive and idler pulleys.

SUMMARY OF THE INVENTION

One aspect of the present invention provides a carriage drive belt for an inkjet printer. The carriage drive belt includes an elongated belt section and a compliant belt section secured to the elongated belt section. The elongated belt section has a longitudinal axis and includes a first portion and a second portion spaced from the first portion along the longitudinal axis. The compliant belt section extends between the first portion and the second portion of the elongated belt section and has an axis extending in a direction of the longitudinal axis of the elongated belt section.

Another aspect of the present invention provides a method of forming a carriage drive belt for an inkjet printer. The method includes providing an elongated belt section having a longitudinal axis and including a first portion and a second portion spaced from the first portion along the longitudinal axis, extending a compliant belt section having an axis and including a first end and a second end between the first portion and the second portion of the elongated belt section, and securing the compliant belt section to the elongated belt section. Extending the compliant belt section between the first portion and the second portion of the elongated belt section includes extending the axis of the compliant belt section in a direction of the longitudinal axis of the elongated belt section. Securing the compliant belt section to the elongated belt section includes securing the first end of the compliant belt section to the first portion of the elongated belt section and securing the second end of the compliant belt section to the second portion of the elongated belt section.

Another aspect of the present invention provides an inkjet printer. The inkjet printer includes a first pulley and a second pulley, and a carriage drive belt. The second pulley is spaced a fixed distance from the first pulley and the carriage drive belt extends around and between the first pulley and the second pulley. The carriage drive belt includes an elongated belt section and a compliant belt section. The elongated belt section has a longitudinal axis and includes a first portion and a second portion spaced from the first portion along the longitudinal axis. The compliant belt section extends between and is secured to the first portion and the second portion of the elongated belt section such that an axis of the compliant belt section extends in a direction of the longitudinal axis of the elongated belt section.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," etc. is used with reference to the orientation of the figures being described. The inkjet printing system and related components of the present invention can be positioned in a number of different orientations. As such, the directional terminology is used for purpose of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
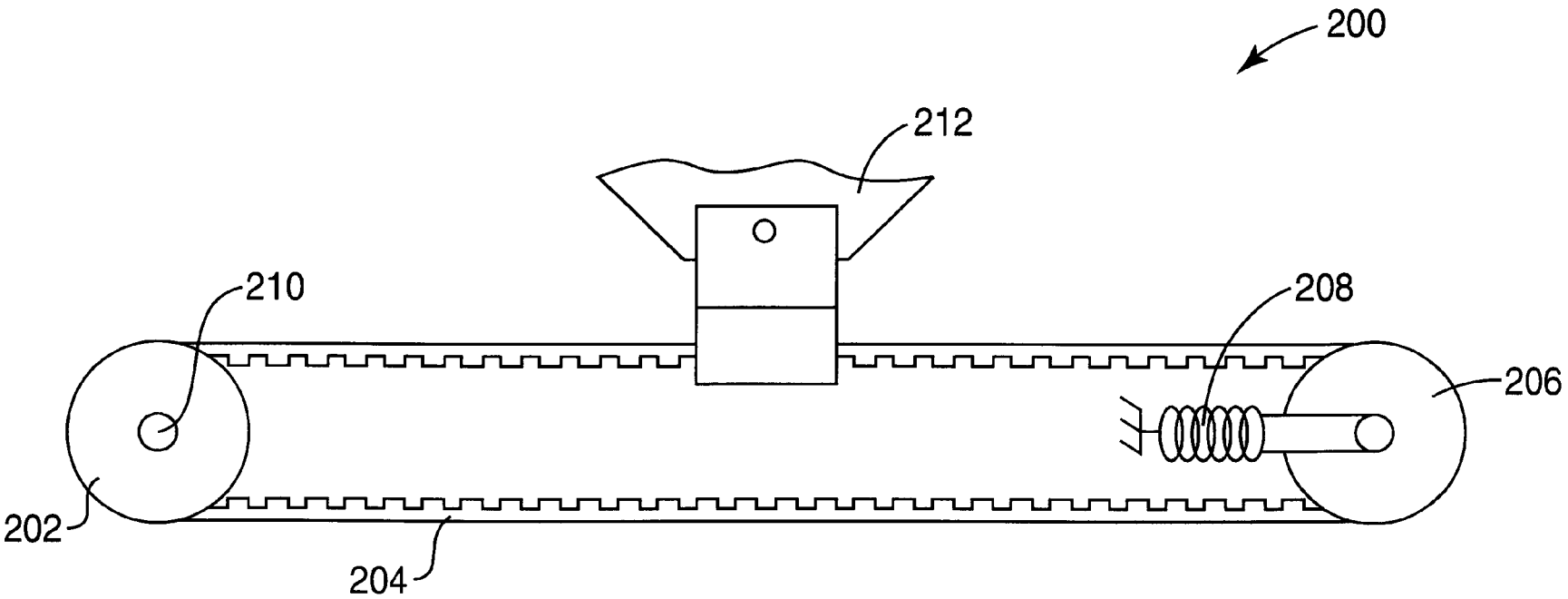
Fig. 1 PRIOR ART
FIG. 1 is a schematic view of a portion of a prior art carriage drive assembly.
Figure 2:
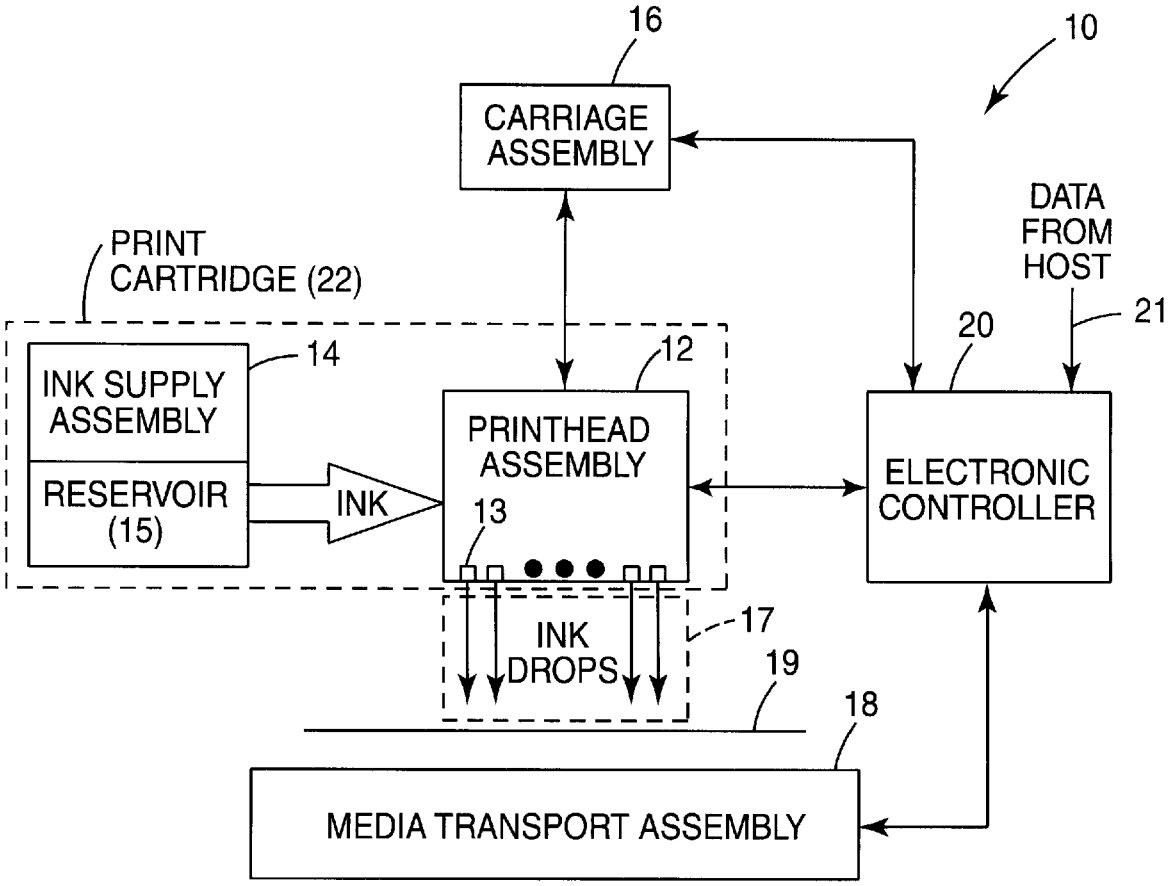
FIG. 2 is a block diagram illustrating one embodiment of an inkjet printing system according to the present invention.

FIG. 2 illustrates one embodiment of a portion of an inkjet printing system 10 according to the present invention. Inkjet printing system 10 includes an inkjet printhead assembly 12, an ink supply assembly 14, a carriage assembly 16, a media transport assembly 18, and an electronic controller 20. Inkjet printhead assembly 12 includes a printhead which ejects drops of ink through a plurality of orifices or nozzles 13 and toward a print medium 19 so as to print onto print medium 19. Print medium 19 is any type of suitable sheet material, such as paper, cardstock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet print cartridge or pen as defined by dashed line 22. In another embodiment, ink supply assembly 14 is separate from ink printhead assembly 12 and supplies ink to inkjet printhead assembly 12. In either embodiment, reservoir 15 of ink supply assembly 14 may be removed, replaced, and/or refilled.

Carriage assembly 16 positions inkjet printhead assembly 12 relative to media transport assembly 18, and media transport assembly 18 positions print medium 19 relative to the inkjet printhead assembly 12. Thus, a print zone 17 is defined adjacent to nozzles 13 in an area between inkjet printhead assembly 12 and print medium 19. In a scanning-type printing system, carriage assembly 16 moves inkjet printhead assembly 12 relative to media transport assembly 18 to scan print medium 19. As such, carriage assembly 16 includes a carriage and a carriage drive assembly, as described below. Thus, print cartridge 22 is positioned in and supported by the carriage and the carriage drive assembly moves print cartridge 22, including inkjet printhead assembly 12, back and forth across print medium 19.

Electronic controller 20 communicates with inkjet printhead assembly 12, carriage assembly 16, and media transport assembly 18. Electronic controller 20 receives data 21 from a host system, such as a computer, and includes memory for temporarily storing data 21. Data 21 represents, for example, a document and/or file to be printed. As such, data 21 forms a print job for inkjet printing system 10 and includes one or more print job commands and/or command parameters.

Electronic controller 20 provides control of inkjet printhead assembly 12 including timing control for ejection of ink drops from nozzles 13. Electronic controller 20 also provides control of carriage assembly 16 including timing and a direction of movement relative to print medium 19. As such, electronic controller 20 defines a pattern of ejected ink drops which form characters, symbols, and/or other graphics or images on print medium 19. Timing control and, therefore, the pattern of ejected ink drops are determined by the print job commands and/or command parameters.

Figure 3A:
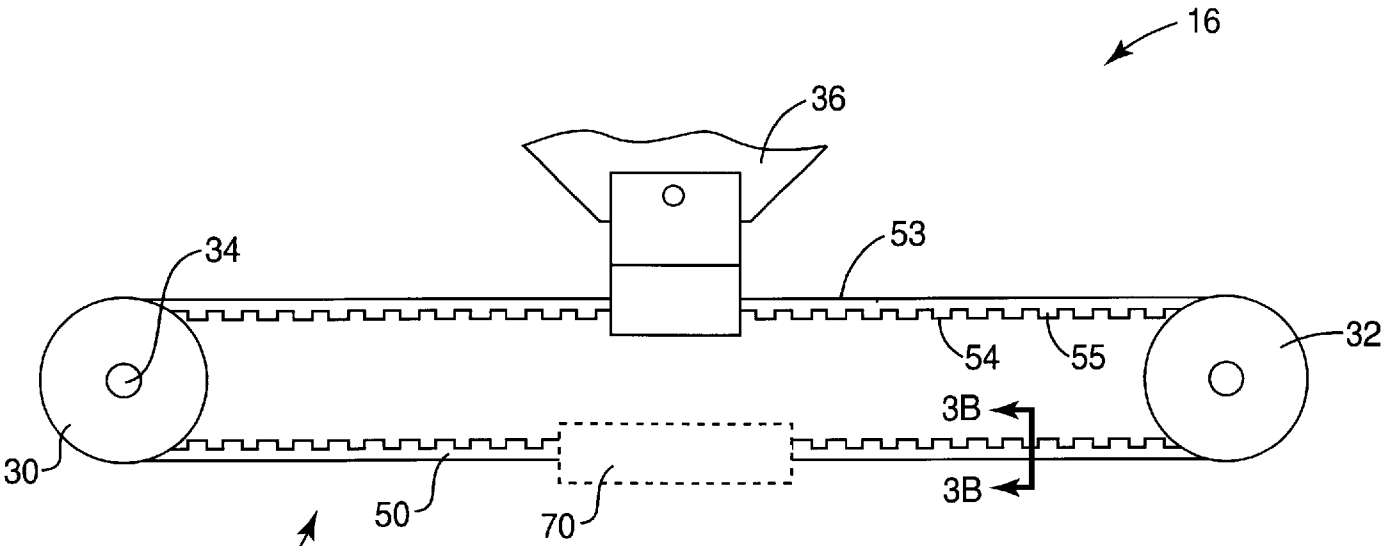
FIG. 3A is a schematic view of a portion of a carriage drive assembly including a carriage drive belt according to the present invention.

As illustrated in FIG. 3A, carriage assembly 16 includes a drive pulley 30 and an idler pulley 32. Idler pulley 32 is spaced from and positioned in the same plane as drive pulley 30. Drive pulley 30 is attached to a drive motor (not shown) by a drive shaft 34 to provide rotational power to and, thus, rotate drive pulley 30 according to electrical signals received from electronic controller 20. Preferably, drive pulley 30 and idler pulley 32 are arranged in a fixed center design. More specifically, drive pulley 30 and idler pulley 32 are spaced a fixed distance from each other. Drive pulley 30 and idler pulley 32, therefore, constitute a fixed drive pulley and a fixed idler pulley, respectively.

A carriage drive belt 40 extends around and between drive pulley 30 and idler pulley 32. Carriage drive belt 40 includes a main or elongated belt section 50 which is a relatively narrow and long strip. Elongated belt section 50 forms a predominate portion of carriage drive belt 40 and includes a first side 53 and a second side 54 opposite first side 53. Preferably, second side 54 has a toothed contour 55 that contacts drive pulley 30 and idler pulley 32.

In one embodiment, drive pulley 30 and idler pulley 32 each have a toothed contour corresponding with toothed contour 55 to more effectively transmit rotational power to drive belt 40. As such, toothed contour 55 of elongated belt section 50 mates with the reciprocal toothed contours of drive pulley 30 and idler pulley 32. Mating of the toothed contours prevents elongated belt section 50 from slipping relative to drive pulley 30 and ensures consistent contact with drive pulley 30. As a result, drive pulley 30 is rotated by the drive motor and drive belt 40 moves back and forth accordingly.

In one embodiment, a carriage 36 (only a portion of which is illustrated in FIG. 3A) is securely attached to carriage drive belt 40. As such, back and forth movement of carriage drive belt 40 invokes similar movement of carriage 36. Carriage 36 holds and carries print cartridge 22, including inkjet printhead assembly 12, for movement relative to print medium 19.

Figure 3B:
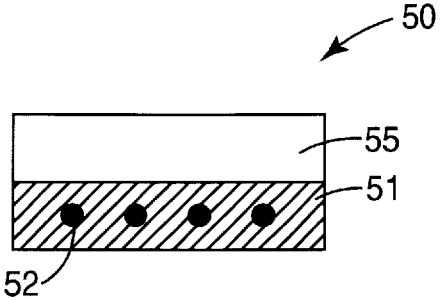
FIG. 3B is a cross-sectional view from the perspective of line 3B—3B of FIG. 3A illustrating one embodiment of the carriage drive belt.

In one embodiment, as illustrated in FIG. 3B, elongated belt section 50 is formed of an elastomeric material 51 molded around a plurality of reinforcing fiber cords 52. In one illustrative embodiment, elongated belt section 50 is formed of polyurethane molded around KEVLAR brand reinforcing fiber cords. It is, however, within the scope of the present invention for elongated belt section 50 to be formed of other elastomeric materials and/or reinforcing fiber cords.

Carriage drive belt 40 includes a compliant belt section 70. Compliant belt section 70 has elastic properties to prevent slack and provide a sufficient pre-load tension in carriage drive belt 40 and to ensure and maintain consistent contact between carriage drive belt 40 and drive pulley 30. The elastic properties of compliant belt section 70 also allow carriage drive belt 40 to accommodate variations in distance between drive pulley 30 and idler pulley 32, variations in diameter of drive pulley 30 and/or idler pulley 32, as well as a variation in length of carriage drive 40, any of which may occur from one inkjet printer to another inkjet printer due to manufacturing variances and/or environmental conditions such as temperature and humidity.

In one embodiment, compared to elongated belt section 50, compliant belt section 70 has a relatively low stiffness. Consequently compliant belt section 70 stretches to accommodate tension in carriage drive belt 40 and, thus, prevent deformation or elongation of elongated belt section 50. As such, compliant belt section 70 provides a tension which varies with displacement. More specifically, as a length of compliant belt section 70 increases, a tension of compliant belt section 70 and, therefore, carriage drive belt 40 increases. Thus, compliant belt section 70 includes a linear or non-linear spring rate which may vary based on particulars of inkjet printing system 10 such as a mass of printer carriage 36. While compliant belt section 70 is illustrated as being located opposite the attachment of carriage 36, it is understood that the location of compliant belt section 70 may vary. Preferred embodiments of compliant belt section 70 are described in detail below.

Figure 4A:
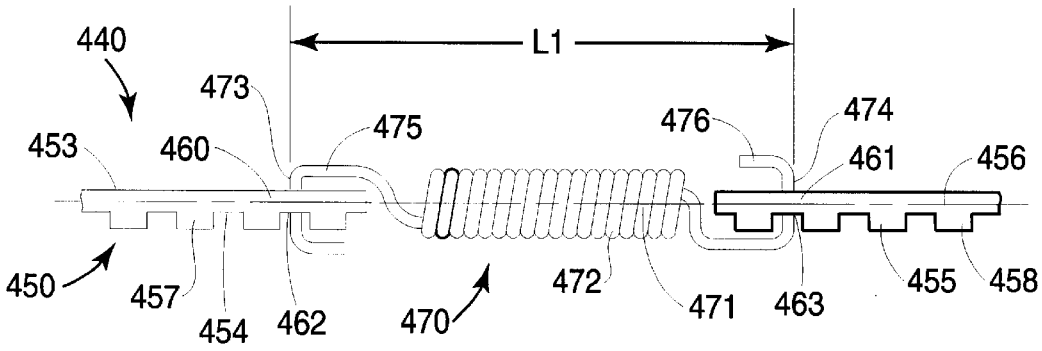
FIG. 4A is a side view of a portion of the carriage drive belt of FIG. 3A illustrating one embodiment of a portion of an elongated belt section and a compliant belt section in a relaxed state according to the present invention.
Figure 4B:
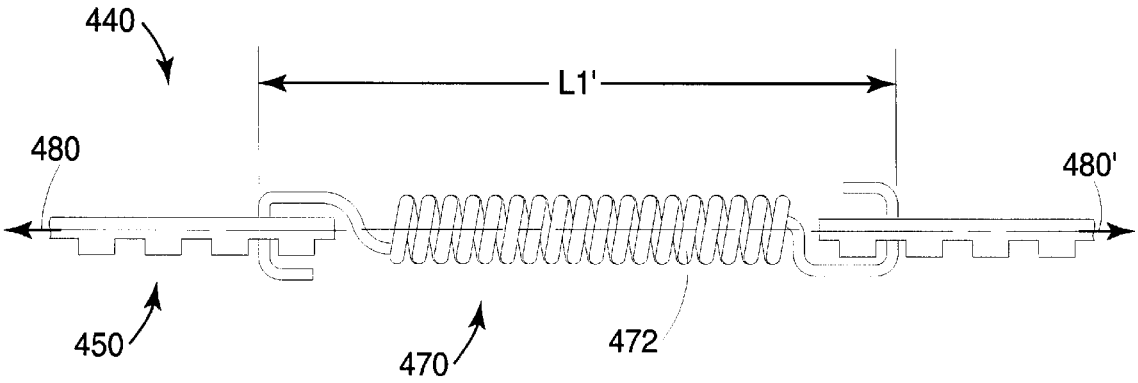
FIG. 4B is a side view illustrating the elongated belt section and the compliant belt section of FIG. 4A in a tensioned state.

FIGS. 4A and 4B illustrate one embodiment of a portion of carriage drive belt 40 including one embodiment of elongated belt section 50 and compliant belt section 70. More specifically, carriage drive belt 440 includes an elongated belt section 450 and a compliant belt section 470. Elongated belt section 450 has a first side 453 and a second side 454 opposite first side 453. In one embodiment, second side 454 has a toothed contour 455. Carriage drive belt 440 is positioned around drive pulley 30 and idler pulley 32 (FIG. 3) such that toothed contour 455 of elongated belt section 450 contacts drive pulley 30 and idler pulley 32.

Elongated belt section 450 has a longitudinal axis 456 and includes a first portion 457 and a second portion 458. First portion 457 and second portion 458 are located along longitudinal axis 456, and second portion 458 is spaced from first portion 457 in the direction of longitudinal axis 456. In one embodiment, first portion 457 forms a first end 460 of elongated belt section 450, and second portion 458 forms a second end 461 of elongated belt section 450. As such, elongated belt section 450 does not form a continuous loop.

Compliant belt section 470 extends between and is secured to first portion 457 and second portion 458 of elongated belt section 450. Compliant belt section 470 has a longitudinal axis 471 which extends in a direction of and substantially coincides with longitudinal axis 456 of elongated belt section 450. Compliant belt section 470 includes a tension spring 472 which extends axially with respect to longitudinal axis 471. As such, tension spring 472 maintains tension in carriage drive belt 440. In one embodiment, tension spring 472 is a helical coil spring which exhibits elastic properties with little or no creep over time. Use of other springs or other elastic materials with similar elastic properties such as spring rate, however, is within the scope of the present invention.

Compliant belt section 470 has a first end 473 and a second end 474. First end 473 is secured to first portion 457 of elongated belt section 450, and second end 474 is secured to second portion 458 of elongated belt section 450. As such, compliant belt section 470 and elongated belt section 450 interact to form a continuous loop.

In one embodiment, first end 473 of compliant belt section 470 has a first hook 475, and first portion 457 of elongated belt section 450 has a first hole 462. Similarly, second end 474 of compliant belt section 470 has a second hook 476, and second portion 458 of elongated belt section 450 has a second hole 463. As such, first hole 462 receives first hook 475 and second hole 463 receives second hook 476, such that compliant belt section 470 is securely attached to elongated belt section 450. It is understood that first hole 462 and second hole 463 may be reinforced, if necessary, with, for example, a grommet or other reinforcement.

FIG. 4A illustrates a portion of carriage drive belt 440 including elongated belt section 450 and compliant belt section 470 in a relatively relaxed state. As such, in the relatively relaxed state, compliant belt section 470 of carriage drive belt 440 has a relaxed length L1.

FIG. 4B illustrates the portion of carriage drive belt 440 illustrated in FIG. 4A in a tensioned state as indicated by opposing arrows 480 and 480'. When carriage drive belt 440 is placed in tension, compliant belt section 470 stretches to a length L1'. Compliant belt section 470, however, retains the ability to return to relaxed length LI because of the elastic properties provided by tension spring 472. As such, by stretching to length L1', compliant belt section 470 prevents excess stretching and/or permanent deformation of elongated belt section 450. Furthermore, by preventing stretching of elongated belt section 450, compliant belt section 470 also prevents distortion of toothed contour 455 of second side 454 of elongated belt section 450, which could lead to inconsistent contact and/or slippage between carriage drive belt 440 and drive pulley 30 and/or idler pulley 32.

Compliant belt section 470 and, more specifically, tension spring 472 maintains carriage drive belt 440 tight against drive pulley 30 and idler pulley 32. As such, carriage drive belt 440 maintains a sufficient pre-load tension to ensure efficient power transmission from drive pulley 30 to carriage drive belt 440. Furthermore, the elastic properties of compliant belt section 470 permit compliant belt section 470 to regain its relatively relaxed length during nontensioned periods, therefore, further decreasing the possibility of permanent deformation of elongated belt section 450.

Figure 5A:
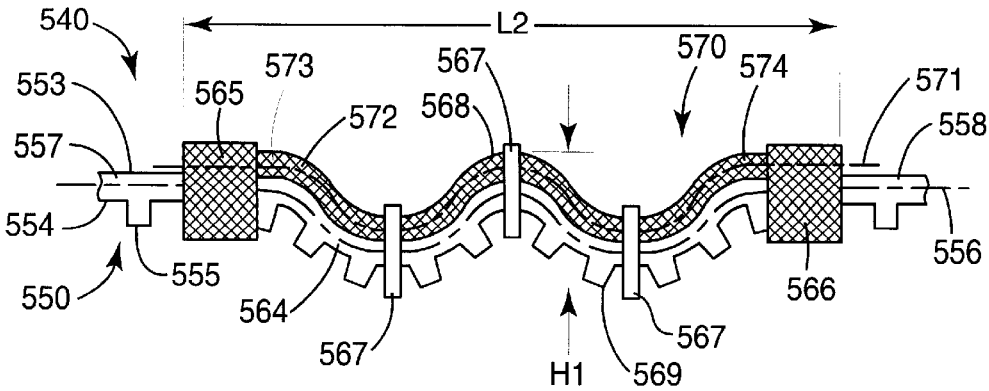
FIG. 5A is a side view of a portion of the carriage drive belt of FIG. 3A illustrating another embodiment of a portion of the elongated belt section and the compliant belt section in a relaxed state according to the present invention.
Figure 5B:
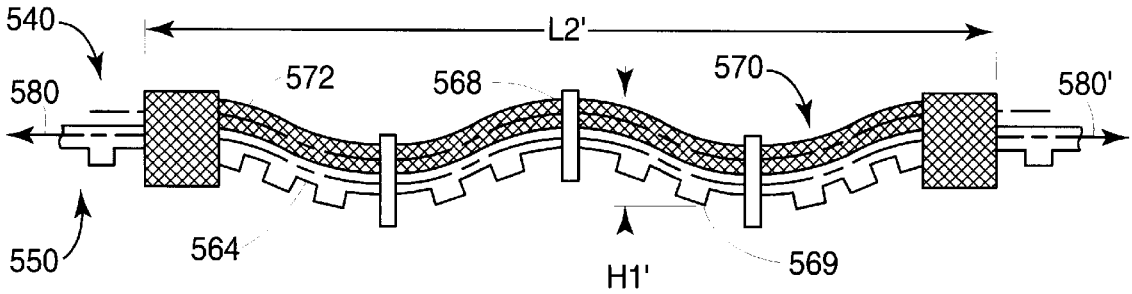
FIG. 5B is a side view illustrating the elongated belt section and the compliant belt section of FIG. 5A in a tensioned state.

FIGS. 5A and 5B illustrate another embodiment of a portion of carriage drive belt 40 including another embodiment of elongated belt section 50 and compliant belt section 70. More specifically, carriage drive belt 540 includes an elongated belt section 550 and a compliant belt section 570. Elongated belt section 550 has a first side 553 and a second side 554 opposite first side 553. In one embodiment, second side 554 has a toothed contour 555. Carriage drive belt 540 is positioned around drive pulley 30 and idler pulley 32 (FIG. 3) in a manner similar to that described above.

Elongated belt section 550 has a longitudinal axis 556 and includes a first portion 557 and a second portion 558. In one embodiment, elongated belt section 550 includes a compliant portion 564 that extends between first portion 557 and second portion 558. In this manner, elongated belt section 550 forms a continuous loop.

Compliant belt section 570 extends between and is secured to first portion 557 and second portion 558 of elongated belt section 550. Compliant belt section 570 has a longitudinal axis 571 which extends in a direction of and is offset from and oriented substantially parallel with longitudinal axis 556 of elongated belt section 550. Compliant belt section 570 includes a tension spring 572 which extends axially with respect to longitudinal axis 571. In one embodiment, tension spring 572 is a wave spring, or flat spring, that exhibits elastic properties with little or no creep over time. Use of other springs or elastic materials with similar elastic properties such as spring rate, however, is within the scope of the present invention.

Compliant belt section 570 has a first end 573 and a second end 574. First end 573 is secured to first portion 557 of elongated belt section 550, and second end 574 is secured to second portion 558 of elongated belt section 550. In one embodiment, first end 573 and second end 574 of compliant belt section 570 are crimped to first portion 557 and second portion 558 of elongated belt section 550 with a first crimp 565 and a second crimp 566, respectively. It is understood, however, that other methods of attachment are within the scope of the present invention.

Compliant belt section 570 is positioned on first side 553 of elongated belt section 550. Compliant belt section 570 is also attached to compliant portion 564 of elongated belt section 550 by a plurality of clips or tabs 567 spaced between first end 573 and second end 574 of compliant belt section 570. Clips 567 maintain the concurrent configuration of compliant portion 564 of elongated belt section 550 and compliant belt section 570 such that a contour of compliant portion 564 follows a contour of compliant belt section 570. As tension spring 572 has a wave configuration including a plurality of peaks and valleys, compliant portion 564 of elongated belt section 550 also has a wave configuration. It is understood that the number of peaks and valleys of tension spring 572 may vary and that the number and/or height of the peaks and valleys, as well as a material of tension spring 572, may be varied to achieve a desired spring rate for compliant belt section 570.

FIG. 5A illustrates a portion of carriage drive belt 540 including elongated belt section 550 and compliant belt section 570 in a relatively relaxed state. When in the relaxed state, compliant belt section 570 and compliant portion 564 have a relaxed length L2. In addition, in the relatively relaxed state, compliant belt section 570 and compliant portion 564 of elongated belt section 550 have a combined height H1, as measured from a peak 568 to a valley 569 of the wave configuration.

FIG. 5B illustrates the portion of carriage drive belt 540 illustrated in FIG. 5A in a tensioned state as indicated by opposing arrows 580 and 580'. When tension is applied to carriage drive belt 540, the wave configuration of compliant belt section 570 and, therefore, compliant portion 564 flattens. More specifically, an amplitude of the wave configuration of tension spring 572 is reduced. As such, height HI decreases to a height H1'. Since height H1' is less than height H1, compliant belt section 570 and compliant portion 564 extend to a length L2', which is greater than relaxed length L2, without permanent deformation or elongation.

When carriage drive belt 540 is placed in tension, as indicated by opposing arrows 580 and 580', the elastic properties of compliant belt section 570 maintain a sufficient pre-load tension in order to provide sufficient contact between carriage drive belt 540 and drive pulley 30 and idler pulley 32. By maintaining sufficient contact, power transmission between drive pulley 30 and carriage drive belt 540 is efficiently maintained.

Figure 6A:
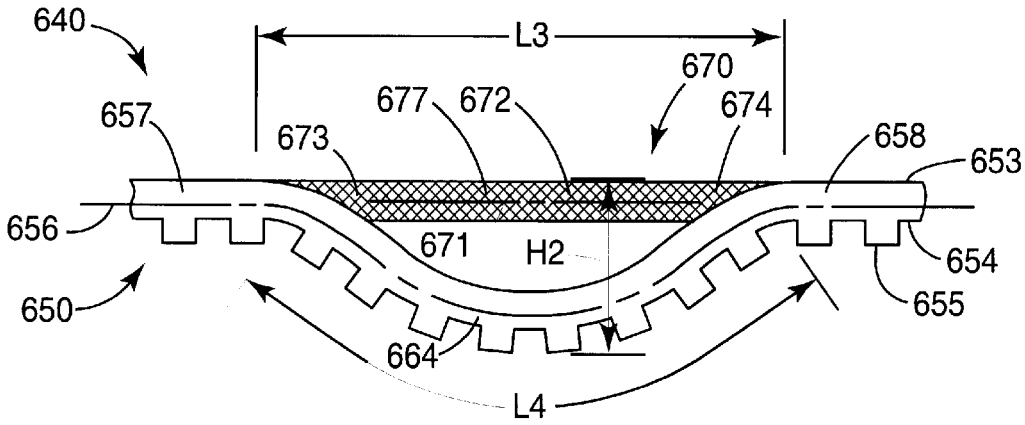
FIG. 6A is a side view of a portion of the carriage drive belt of FIG. 3A illustrating another embodiment of a portion of the elongated belt section and the compliant be section in a relaxed state according to the present invention.
Figure 6B:
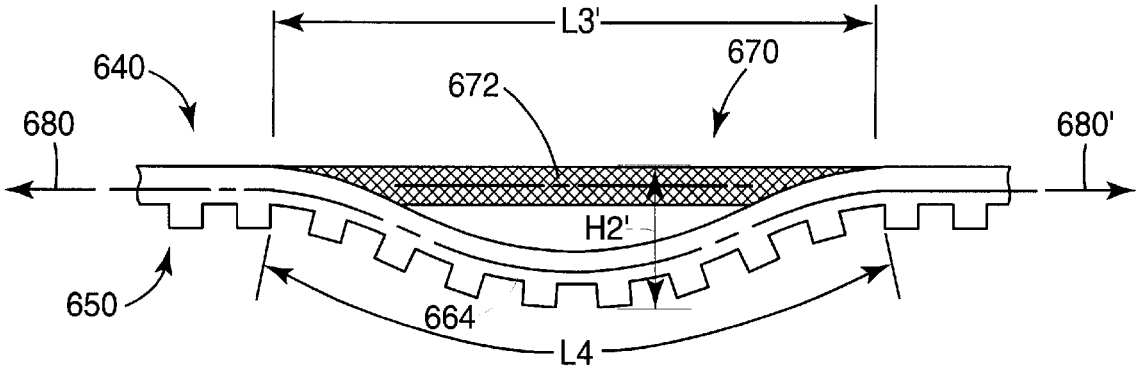
FIG. 6B is a side view illustrating the elongated belt section and the compliant belt section of FIG. 6A in a tensioned state.

FIGS. 6A and 6B illustrate another embodiment of a portion of a carriage drive belt 40 including another embodiment of elongated belt section 50 and compliant belt section 70. More specifically, carriage drive belt 640 includes an elongated belt section 650 and a compliant belt section 670. Elongated belt section 650 has a first side 653 and a second side 654 opposite first side 653. In one embodiment, second side 654 has a toothed contour 655. Carriage drive belt 640 is positioned around drive pulley 30 and idler pulley 32 (FIG. 3) in a manner similar to that described above.

Elongated belt section 650 has a longitudinal axis 656 and includes a first portion 657 and a second portion 658. First portion 657 and second portion 658 are positioned along longitudinal axis 656, and second portion 658 is spaced from first portion 657 in the direction of longitudinal axis 656.

In one embodiment, elongated belt section 650 further includes a compliant portion 664 extending between first portion 657 and second portion 658. As such, elongated belt section 650 forms a continuous loop. Compliant portion 664 includes a loop of elongated belt section 650 formed between first portion 657 and second portion 658.

Compliant belt section 670 extends between and is secured to first portion 657 and second portion 658 of elongated belt section 650. Compliant belt section 670 has a longitudinal axis 671 that extends in a direction of and substantially coincides with longitudinal axis 656 of elongated belt section 650. Compliant belt section 670 includes a compliant segment 672 which extends axially with respect to longitudinal axis 671. Compliant segment 672 includes a band of an elastic material 677 having sufficient resiliency to avoid the onset of creep or permanent deformation over time. An example of elastic material 677 includes polyurethane. While compliant segment 672 is illustrated as a uniform band, it is within the scope of the present invention for compliant segment 672 to have a shape which follows a contour of compliant portion 664.

Compliant belt section 670 has a first end 673 and a second end 674 bonded to first portion 657 and second portion 658 of elongated belt section 650, respectively. Compliant belt section 670 is positioned on first side 653 of elongated belt section 650 and compliant portion 664 of elongated belt section 650 coincides with the position of compliant belt section 670.

FIG. 6A illustrates a portion of carriage drive belt 640 including elongated belt section 650 and compliant belt section 670 in a relatively relaxed state. Compliant belt section 670 has a relaxed length L3 that is shorter than a length L4 of compliant portion 664 of elongated belt section 650. As such, compliant portion 664 forms a loop that hangs loosely away from compliant belt section 670 to define a relaxed height H2 from the top of compliant belt section 670 to the bottom of compliant portion 664.

FIG. 6B illustrates the portion of carriage drive belt 640 illustrated in FIG. 6A in a tensioned state as indicated by opposing arrows 680 and 680'. When tension is applied to carriage drive belt 640, compliant belt section 670 stretches as needed to ensure that carriage drive belt 640 maintains proper contact with drive pulley 30 and idler pulley 32 and, thereby, maintains a sufficient pre-load tension for efficient power transmission between drive pulley 30 and carriage drive belt 640. Not only does compliant belt section 670 act to tightly maintain carriage drive belt 640 around drive pulley 30 and idler pulley 32, the elastic properties of compliant belt section 670 also allow compliant belt section 670 to temporarily deform to a length L3' while compliant portion 664 of elongated belt section 650 maintains original length L4.

As compliant belt section 670 stretches with the applied tension, height H2, consequently, decreases to a height H2'. Height H2' is maintained at a measurable distance such that length L3' of compliant belt section 670 remains shorter than length L4 of compliant portion 664, even when in the tensioned state. Since length L3' is shorter than length L4, compliant portion 664 is not pulled tight and, consequently, does not elongate or deform.

Figure 7A:
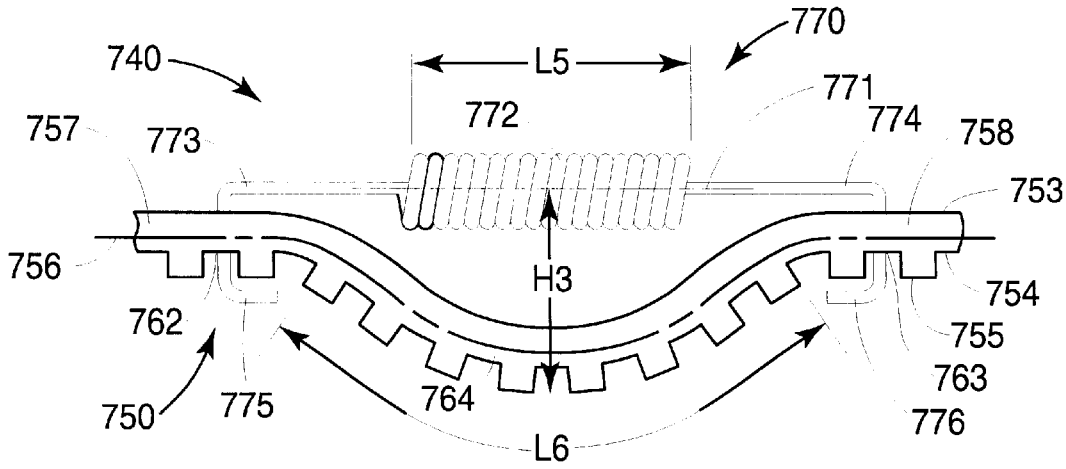
FIG. 7A is a side view of a portion of the carriage drive belt of FIG. 3A illustrating another embodiment of a portion of the elongated belt section and the compliant belt section in a relaxed state according to the present invention.
Figure 7B:
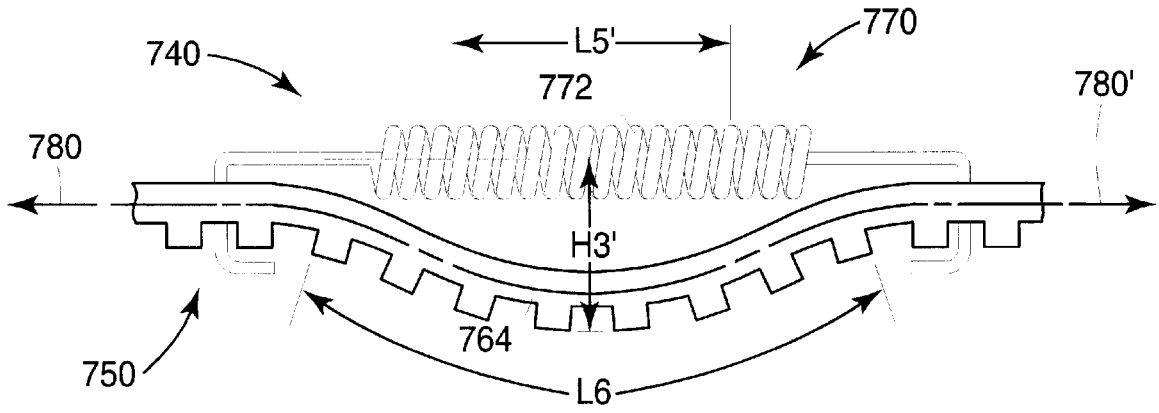
FIG. 7B is a side view illustrating the elongated belt section and the compliant belt section of FIG. 7A in a tensioned state.

FIGS. 7A and 7B illustrate another embodiment of a portion of a carriage drive belt 40 including another embodiment of elongated belt section 50 and compliant belt section 70. More specifically, carriage drive belt 740 includes an elongated belt section 750 and a compliant belt section 770. Elongated belt section 750 has a first side 753 and a second side 754 opposite first side 753. In one embodiment, second side 754 has a toothed contour 755. Carriage drive belt 740 is positioned around drive pulley 30 and idler pulley 32 (FIG. 3) in a manner similar to that described above.

Elongated belt section 750 has a longitudinal axis 756 and includes a first portion 757 and a second portion 758. First portion 757 and second portion 758 are positioned along longitudinal axis 756, and second portion 758 is spaced from first portion 757 in the direction of longitudinal axis 756.

In one embodiment, elongated belt section 750 further includes a compliant portion 764 extending between first portion 757 and second portion 758. As such, elongated belt section 750 forms a continuous loop. Compliant portion 764 includes a loop of elongated belt section 750 formed between first portion 757 and second portion 758.

Compliant belt section 770 extends between and is secured to first portion 757 and second portion 758 of elongated belt section 750. Compliant belt section 770 has a longitudinal axis 771 which extends in a direction of and is offset from and oriented substantially parallel with longitudinal axis 756 of elongated belt section 750. Compliant belt section 770 includes a tension spring 772 which extends axially with respect to longitudinal axis 771. As such, tension spring 772 maintains tension in carriage drive belt 740. In one embodiment, tension spring 772 is a helical coil spring which exhibits elastic properties with little or no creep over time. Use of other springs or other elastic materials with similar elastic properties such as spring rate, however, is within the scope of the present invention.

Compliant belt section 770 has a first end 773 and a second end 774. First end 773 is secured to first portion 757 of elongated belt section 750, and second end 774 is secured to second portion 758 of elongated belt section 750. Compliant belt section 770 is positioned on first side 753 of elongated belt section 750 and compliant portion 764 of elongated belt section 750 coincides with the position of compliant belt section 770.

In one embodiment, first end 773 of compliant belt section 770 has a first hook 775, and first portion 757 of elongated belt section 750 has a first hole 762. Similarly, second end 774 of compliant belt section 770 has a second hook 776, and second portion 758 of elongated belt section 750 has a second hole 763. As such, first hole 762 receives first hook 775 and second hole 763 receives second hook 776, such that compliant belt section 770 is securely attached to elongated belt section 750. It is understood that first hole 762 and second hole 763 may be reinforced, if necessary, with, for example, a grommet or other reinforcement.

FIG. 7A illustrates a portion of carriage drive belt 740 including elongated belt section 750 and compliant belt section 770 in a relatively relaxed state. Compliant belt section 770 has a relaxed length L5 that is shorter than a length L6 of compliant portion 764 of elongated belt section 750. As such, compliant portion 764 forms a loop that hangs loosely away from compliant belt section 770 to define a relaxed height H3 from the top of compliant belt section 770 to the bottom of compliant portion 764.

FIG. 7B illustrates the portion of carriage drive belt 740 illustrated in FIG. 7A in a tensioned state as indicated by opposing arrows 780 and 780'. When tension is applied to carriage drive belt 740, compliant belt section 770 stretches as needed to ensure that carriage drive belt 740 maintains proper contact with drive pulley 30 and idler pulley 32 and, thereby, maintains a sufficient pre-load tension for efficient power transmission between drive pulley 30 and carriage drive belt 740. Not only does compliant belt section 770 act to tightly maintain carriage drive belt 740 around drive pulley 30 and idler pulley 32, the elastic properties of compliant belt section 770 also allow compliant belt section 770 to temporarily deform to a length L5' while compliant portion 764 of elongated belt section 750 maintains original length L6.

As compliant belt section 770 stretches with the applied tension, height H3, consequently, decreases to a height H3'. Height H3' is maintained at a measurable distance such that length L5' of compliant belt section 770 remains shorter than length L6 of compliant portion 764, even when in the tensioned state. Since length L5' is shorter than length L6, compliant portion 764 is not pulled tight and, consequently, does not elongate or deform.

Compliant belt section 70 (including compliant belt sections 470, 570, 670, and 770) maintains a sufficient pre-load tension in carriage drive belt 40 (including respective carriage drive belts 440, 540, 640, and 740) for efficient power transmission between pulleys 30 and 32 and carriage drive belt 40. Maintaining a sufficient pre-load tension also ensures consistent movement of carriage drive belt 40 and, therefore, carriage 36 across print medium 19. Accordingly, replacing a conventional belt tensioning arrangement including a belt tension spring and an adjustable idler pulley with a carriage drive belt including a compliant belt section and fixing the idler pulley would increase power transmission efficiency and manufacturing simplicity while reducing cost.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A carriage drive belt for an inkjet printer, the carriage drive belt comprising:

an elongated belt section having a longitudinal axis and including a first portion and a second portion spaced from the first portion along the longitudinal axis; and a compliant belt section secured to the elongated belt section, wherein the compliant belt section extends between the first portion and the second portion of the elongated belt section and has an axis extending in a direction of the longitudinal axis of the elongated belt section.

2. The carriage drive belt of claim 1, wherein the compliant belt section is formed separately from and secured to the first portion and the second portion of the elongated belt section.

3. The carriage drive belt of claim 1, wherein the axis of the compliant belt section substantially coincides with the longitudinal axis of the elongated belt section.

4. The carriage drive belt of claim 1, wherein the axis of the compliant belt section is oriented substantially parallel with the longitudinal axis of the elongated belt section.

5. The carriage drive belt of claim 1, wherein the compliant belt section has a first end secured to the first portion of the elongated belt section and a second end secured to the second portion of the elongated belt section.

6. The carriage drive belt of claim 5, wherein the first portion of the elongated belt section forms a first end of the elongated belt section and the second portion of the elongated belt section forms a second end of the elongated belt section, wherein the first end of the compliant belt section is secured to the first end of the elongated belt section and the second end of the compliant belt section is secured to the second end of the elongated belt section.

7. The carriage drive belt of claim 5, wherein the first end of the compliant belt section is crimped to the first portion of the elongated belt section and the second end of the compliant belt section is crimped to the second portion of the elongated belt section.

8. The carriage drive belt of claim 5, wherein the first end of the compliant belt section includes a first hook and the second end of the compliant belt section includes a second hook, wherein the first portion of the elongated belt section has a first hole defined therein and the second portion of the elongated belt section has a second hole defined therein, and wherein the first hole is adapted to receive the first hook and the second hole is adapted to receive the second hook.

9. The carriage drive belt of claim 5, wherein the compliant belt section is bonded to the elongated belt section.

10. The carriage drive belt of claim 1, wherein the elongated belt section forms a continuous loop and has a first side and a second side opposite the first side, wherein the compliant belt section is disposed on the first side of the elongated belt section and the second side of the elongated belt section has a toothed contour.

11. The carriage drive belt of claim 10, wherein the elongated belt section includes a compliant portion extending between the first portion and the second portion thereof, wherein the compliant belt section is secured to the compliant portion of the elongated belt section.

12. The carriage drive belt of claim 11, wherein a contour of the compliant portion of the elongated belt section follows a contour of the compliant belt section.

13. The carriage drive belt of claim 11, wherein the compliant belt section is secured to the compliant portion of the elongated belt section intermediate the first portion and the second portion.

14. The carriage drive belt of claim 11, wherein the compliant portion of the elongated belt section has a length, wherein the compliant belt section has a relaxed length, and wherein the length of the compliant portion of the elongated belt section is greater than the relaxed length of the compliant belt section and the compliant portion of the elongated belt section forms a loop.

15. The carriage drive belt of claim 1, wherein the compliant belt section includes a tension spring having a first end secured to the first portion of the elongated belt section and a second end secured to the second portion of the elongated belt section.

16. The carriage drive belt of claim 15, wherein the tension spring is a coil spring.

17. The carriage drive belt of claim 15, wherein the tension spring is a wave spring.

18. The carriage drive belt of claim 1, wherein the compliant belt section includes a compliant segment having a first end secured to the first portion of the elongated belt section and a second end secured to the second portion of the elongated belt section.

19. The carriage drive belt of claim 18, wherein the elongated belt section includes a non-elastic material and the compliant segment is formed of a material having elastic properties.

20. A method of forming a carriage drive belt for an inkjet printer, the method comprising:

providing an elongated belt section having a longitudinal axis and including a first portion and a second portion spaced from the first portion along the longitudinal axis;

extending a compliant belt section having an axis and including a first end and a second end between the first portion and the second portion of the elongated belt section, including extending the axis of the compliant belt section in a direction of the longitudinal axis of the elongated belt section; and securing the compliant belt section to the elongated belt section, including securing the first end of the compliant belt section to the first portion of the elongated belt section and securing the second end of the of the compliant belt section to the second portion of the elongated belt section.

21. The method of claim 20, wherein extending the compliant belt section between the first portion and the second portion of the elongated belt section includes substantially coinciding the axis of the compliant belt section with the longitudinal axis of the elongated belt section.

22. The method of claim 20, wherein extending the compliant belt section between the first portion and the second portion of the elongated belt section includes orienting the axis of the compliant belt section substantially parallel with the longitudinal axis of the elongated belt section.

23. The method of claim 20, wherein the elongated belt section has a first end and a second end, and wherein securing the compliant belt section to the elongated belt section includes securing the first end of the compliant belt section to the first end of the elongated belt section and securing the second end of the of the compliant belt section to the second end of the elongated belt section.

24. The method of claim 20, wherein providing the elongated belt section includes providing a compliant portion extending between the first portion and the second portion of the elongated belt section and forming the elongated belt section as a continuous loop.

25. The method of claim 24, wherein providing the compliant portion extending between the first portion and the second portion of the elongated belt section includes forming a loop with the compliant portion.

26. The method of claim 20, wherein extending the compliant belt section between the first portion and the second portion of the elongated belt section includes extending one of a tension spring and a compliant segment between the first portion and the second portion of the elongated belt section.

27. The method of claim 20, wherein securing the compliant belt section to the elongated belt section includes hooking the first end of the compliant belt section to the first portion of the elongated belt section and hooking the second end of the compliant belt section to the second portion of the elongated belt section.

28. The method of claim 20, wherein securing the compliant belt section to the elongated belt section includes crimping the first end of the compliant belt section to the first portion of the elongated belt section and crimping the second end of the compliant belt section to the second portion of the elongated belt section.

29. The method of claim 28, wherein securing the compliant belt section to the elongated belt section further includes securing the compliant belt section to the elongated belt section intermediate the first portion and the second portion of the elongated belt section.

30. The method of claim 20, wherein securing the compliant belt section to the elongated belt section includes bonding the first end of the compliant belt section to the first portion of the elongated belt section and bonding the second end of the compliant belt section to the second portion of the elongated belt section.

31. An inkjet printer, comprising:

a first pulley and a second pulley spaced a fixed distance from the first pulley; and a carriage drive belt extending around and between the first pulley and the second pulley, the carriage drive belt including:

an elongated belt section having a longitudinal axis and including a first portion and a second portion spaced from the first portion along the longitudinal axis, and a compliant belt section extending between and secured to the first portion and the second portion of the elongated belt section, wherein an axis of the compliant belt section extends in a direction of the longitudinal axis of the elongated belt section.

32. The inkjet printer of claim 31, wherein the compliant belt section is adapted to maintain a minimum pre-load tension of the carriage drive belt.

33. The inkjet printer of claim 31, wherein the axis of the compliant belt section substantially coincides with the longitudinal axis of the elongated belt section.

34. The inkjet printer of claim 31, wherein the axis of the compliant belt section is oriented substantially parallel with the longitudinal axis of the elongated belt section.

35. The inkjet printer of claim 31, wherein the compliant belt section is formed separately from the elongated belt section.

36. The inkjet printer of claim 31, wherein the compliant belt section has a first end secured to the first portion of the elongated belt section and a second end secured to the second portion of the elongated belt section.

37. The inkjet printer of claim 36, wherein the first portion of the elongated belt section forms a first end of the elongated belt section and the second portion of the elongated belt section forms a second end of the elongated belt section, wherein the first end of the compliant belt section is secured to the first end of the elongated belt section and the second end of the compliant belt section is secured to the second end of the elongated belt section.

38. The inkjet printer of claim 31, wherein the elongated belt section forms a continuous loop and has a first side and a second side opposite the first side, wherein the compliant belt section is disposed on the first side of the elongated belt section and the second side of the elongated belt section has a toothed contour.

39. The inkjet printer of claim 38, wherein the elongated belt section includes a compliant portion extending between the first portion and the second portion thereof, wherein the compliant belt section is secured to the compliant portion of the elongated belt section.

40. The inkjet printer of claim 39, wherein the compliant portion of the elongated belt section has a length, wherein the compliant belt section has a relaxed length, and wherein the length of the compliant portion of the elongated belt section is greater than the relaxed length of the compliant belt section and the compliant portion of the elongated belt section forms a loop.

41. The inkjet printer of claim 31, wherein the compliant belt section includes a tension spring having a first end secured to the first portion of the elongated belt section and a second end secured to the second portion of the elongated belt section.

42. The inkjet printer of claim 41, wherein the tension spring is one of a coil spring and a wave spring.

43. The inkjet printer of claim 31, wherein the compliant belt section includes a compliant segment having a first end secured to the first portion of the elongated belt section and a second end secured to the second portion of the elongated belt section.

44. The inkjet printer of claim 43, wherein the elongated belt section includes a non-elastic material and the compliant segment is formed of a material having elastic properties.

45. The inkjet printer of claim 31, further comprising:

a carriage fixed to the carriage drive belt.

* * * * *